US007216786B2

(12) United States Patent
Mikhail et al.

(10) Patent No.: US 7,216,786 B2
(45) Date of Patent: May 15, 2007

(54) NON-SLIP GARMENT HANGER ATTACHMENT

(76) Inventors: Janet Lee Mikhail, 1107 Augustana Dr., Naperville, IL (US) 60565; Matthew Kamel Mikhail, 1107 Augustana Dr., Naperville, IL (US) 60565

( * ) Notice: Subject to any disclaimer, the term of this patent is extended or adjusted under 35 U.S.C. 154(b) by 190 days.

(21) Appl. No.: 10/998,429

(22) Filed: Nov. 29, 2004

(65) Prior Publication Data

US 2006/0113334 A1 Jun. 1, 2006

(51) Int. Cl.
*A41D 27/22* (2006.01)

(52) U.S. Cl. ..... 223/85

(58) Field of Classification Search ..... 223/85, 223/88, 92, 95, 97, 98
See application file for complete search history.

(56) References Cited

U.S. PATENT DOCUMENTS 845,443 A * 12/1907 Allardice ..... 223/95
1,885,236 A * 11/1932 Davenport ..... 192/93 R
2,091,506 A * 8/1937 Guttridge ..... 223/98
2,218,150 A * 10/1940 Jentz ..... 223/98
2,353,839 A * 7/1944 McFall ..... 223/98
2,581,631 A * 1/1952 Carta ..... 223/88
2,739,745 A * 3/1956 Tufts ..... 223/98
3,602,408 A * 8/1971 Gaydos ..... 223/98
3,733,016 A * 5/1973 Rood ..... 223/86
3,866,810 A * 2/1975 Florian ..... 223/98
4,040,545 A * 8/1977 Hill ..... 223/85
4,058,241 A * 11/1977 Craig ..... 223/98
4,160,516 A * 7/1979 Rice ..... 223/98
4,606,482 A * 8/1986 McHugh ..... 223/88
4,944,436 A * 7/1990 Moen et al. ..... 223/98
5,056,694 A * 10/1991 Michalik ..... 223/98
5,197,639 A * 3/1993 Jerman et al. ..... 223/88
5,718,362 A * 2/1998 Silverman ..... 223/94
6,012,620 A * 1/2000 Murray ..... 223/98
6,021,934 A * 2/2000 Ho ..... 223/98
6,126,049 A * 10/2000 Gish ..... 223/96
6,213,359 B1 * 4/2001 Gish ..... 223/98
6,267,275 B1 * 7/2001 Murray ..... 223/98
6,644,521 B1 * 11/2003 Tiss et al. ..... 223/98
6,840,413 B1 * 1/2005 Cameron et al. ..... 223/98

* cited by examiner

*Primary Examiner*—Gary L. Welch

(57) ABSTRACT

A non-slip resilient unitary attachment designed for use on a standard wire hanger. The attachment is shaped or molded with a non-uniform diameter of a resilient rubber or foam rubber or similar material that will deform temporarily to lend itself to better retention of small to medium sized straps typically identified on woman's clothing i.e., camisoles, spaghetti-strapped tops, tank tops. The hanger attachment will be somewhat less than equal to the length of one of the shoulder support bars of the wire hanger. The hanger attachment will be split or cut longitudinally, half the diameter of the hanger attachment, with a tape-backed adhesive placed within the slit of the hanger attachment to close the slit and mechanically maintain its position without other restraints. Two hanger attachment units, left and right respectively, are required for each wire garment hanger

27 Claims, 7 Drawing Sheets

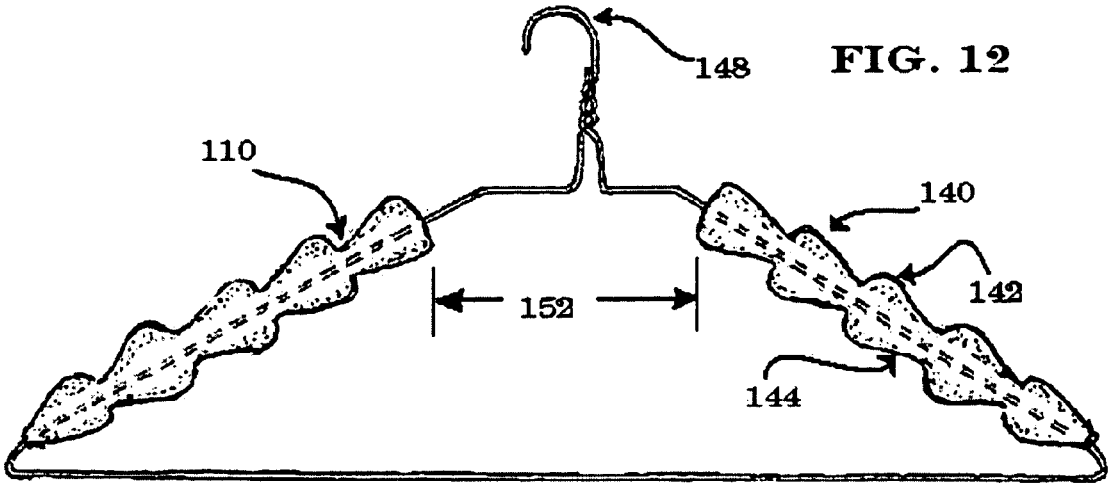
FIG. 12
FIG. 13
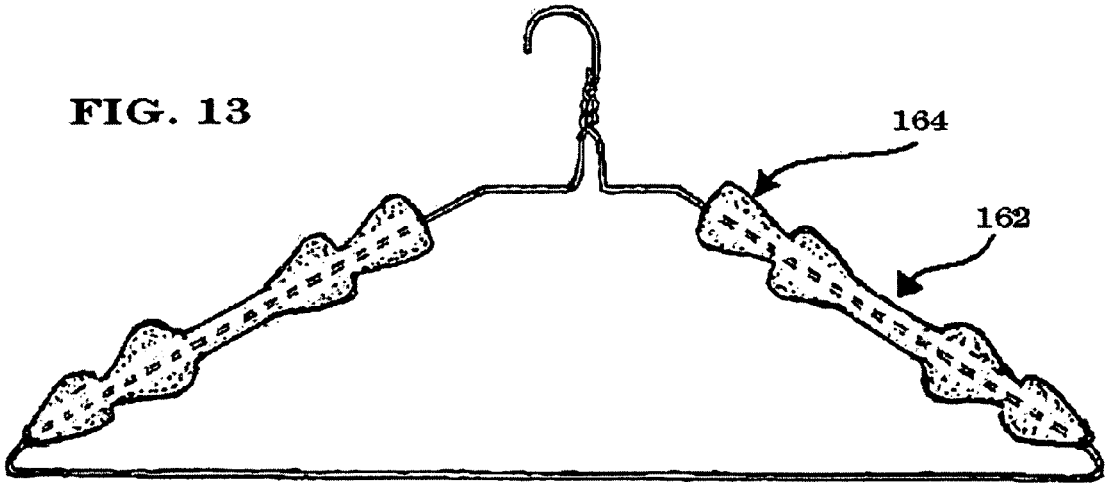

NON-SLIP GARMENT HANGER ATTACHMENT

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

A common occurrence with the re-use of wire hangers typically provided by dry-cleaners and similar garmet cleaning services is the difficulty to place clothing with off the shoulder, small and delicate straps on these hangers without resulting in these clothes slipping off the hanger. Many devices have been designed in an attempt to remedy this problem in a utilitarian method as shown in U.S. Pat. Nos. 6,644,521 B1; 3,866,810; 6,012,620; 5,718,362; 5,197,639; 5,056,694; 6,213,359B1; 6,126,049; 4,160,516; 4,944,436. These attachments are produced from a variety of materials from paper, rigid plastic, foam and other related resilient materials.

For Example:

U.S. Pat. No. 6,644,521 B1 FIG. 4, is made from a resilient material initially flat, cut into a specific pattern to provide for a left and right shoulder support connected by a center section with a central slit to allow for the hook of the hanger to penetrate the support and prevent shifting of the device, once attached. Furthermore, the attachment is loosely folded over the arms of the wire hanger with no true engagement of the left and right shoulder support. This allows for the clothing to dislodge the attachment during the positioning and removal of clothing. This device is designed to prevent creasing of the shoulder straps against the small diameter wire hanger.

U.S. Pat. No. 3,866,810 FIG. 3, illustrates a two-piece device which is made from a thermoformed rigid material. One piece is bedded into the complimentary piece and has an asymmetrical shape, larger at the hook-end and narrower at the terminal-end of the shoulder support. The hook-end has a perforation to allow the central hook of the hanger to penetrate the attachment. The device operates best with a multi-angled downwardly sloping shoulder support for the proper engagement of the central positioned attachment. The device is to be positioned longitudinally and laterally left and right to engage the bend of the wire at the junction of the shoulder support bar and horizontal support bar. The device, once positioned provides a significantly large surface area to prevent creasing, however, does not address the issue of lateral slippage sufficiently, resulting in retention of garment only by frictional contact. If shifting of wire hanger should occur, as would typically be observed with proper use of the hanger, the garment shoulder strap would be free to slide down the attachment. Finally, the breadth of the attachment makes it impractical for efficient storage of garments on the closet hanger rod.

U.S. Pat. No. 3,733,016 FIG. 1, is a rigid thermoplastic attachment to be applied to the upper and lower supporting wires with an internally locking mechanism and end notches to maintain the intended positioning. This device is non-resilient and provides an indent on the upper surface for shoulder strap retention. The complexity of production would make this attachment no longer affordable or reasonable for use on a disposable wire hanger.

U.S. Pat. Nos. 6,012,620 and 6,012,620B1 FIG. 2, represents a linear elongated single foam attachment with a slit and perforation for the wire hanger hook respectively. The attachment must be stretched over the ends of the lateral most aspects of the hanger for proper securement. Although this design is most similar and is principally designed to prevent creasing of garment shoulder area, it has inherent flaws. Its size, by design, is large and difficult to package. While stretching the attachment over the hanger there is a possibility of tearing the attachment ends, which the foam attachment would no longer maintain its intended position as foam has a tendency to return to its pre-positioned shape. This design would be heavily reliant on uniformity of hanger construction and size, whereas a shorter or longer horizontal support could render it useless or ineffective. The single unit embodiment as described, will occupy a greater space within the closet while on the closet hanger rod, ultimately reducing available space in said closet due to hanger attachment abutment. Due to the fact that the wire hanger is extremely inexpensive and quite often free, the invention is similarly inexpensive and the concern of reusability is of little concern thus should be considered disposable. Finally, U.S. Pat. No. 6,012,620B1 is a flocked variant to the original patent requiring additional steps in manufacturing and consequently higher manufacturing costs in order to increase frictional retention of clothing.

As previously discussed, there are numerous varieties of wire hanger attachments of the purpose of clothing retention and crease/deformation prevention. Each design addresses one or more aspects of the aforementioned purpose, however, the complexity of use, assembly, cost of manufacture, reliability once secured to the wire hanger and affording the greatest potential to retain the clothing once positioned on the said wire hanger has not been demonstrated as of yet.

The principle design and utility is simplicity of manufacture, assemblage, and use, at the most cost effective procurement. This design addresses all of the aforementioned and will ultimately be infinitely adjustable for clothing of adult and children alike. While being fun, novel in shape and use of colors in a way to enhance the appearance of the closet.

Other objects and advantages of the present invention will become apparent from the following descriptions, taken in connection with the accompanying drawings, wherein, by way of illustration and example, an embodiment of the present invention is disclosed.

BRIEF SUMMARY OF THE INVENTION

The present invention simplifies the use of the hanger attachment by the use of resilient foam-like material of a unitary construction with a partial cutlslit running the entire length, half the diameter, to engage the wire hanger shoulder support. Within the slit, a tape-backed adhesive will be placed to permanently affix the hanger attachment to the wire and to seal the opposing surfaces of the slit together, creating a closed and solid unit upon the wire shoulder support. The hanger attachment is to be placed on the left and right downwardly sloping shoulder supports of the wire hanger which is principally comprised of two units, identical in design. The overall design is formed or molded lengthwise along a single longitudinal axis. The shape is of a varying diameter forming a lobular pattern, separated by a narrowing, approximately three times the diameter of the wire in thickness. The enlargement will be sufficiently large to accommodate the proper retention of the clothing shoulder swaps. The external surface will be of a non-slip texture and colorfast to prevent damage to fabrics.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

The drawings illustrate the preferred and alternate embodiments of the garment hanger attachment as well as prior art of other inventors.

FIG. 12 Is the alternate embodiment illustrating the conical shaped enlargements and its orientation.

FIG. 13 Is the alternate embodiment with conical enlargements and a plateau in the center derived from the elimination of the mid-line (#3) enlargement as depicted in the illustration.

DETAILED DESCRIPTION OF THE INVENTION

Figure 1:
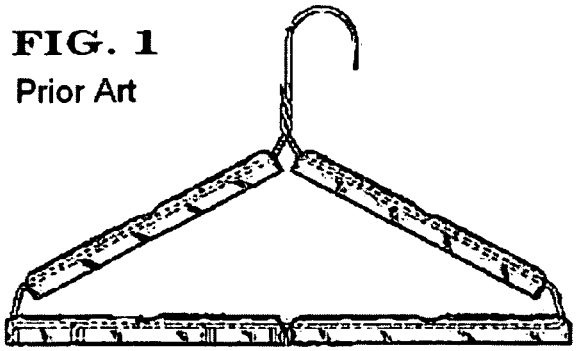
FIG. 1 Prior Art
FIG. 1 Is the prior art of U.S. Pat. No. 3,733,016
Figure 2:
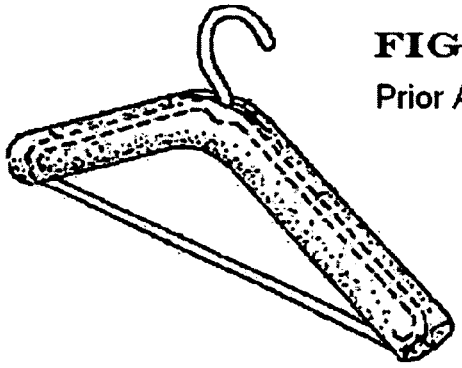
FIG. 2 Prior Art
FIG. 2 Is the prior art of U.S. Pat. No. 6,012,620
Figure 3:
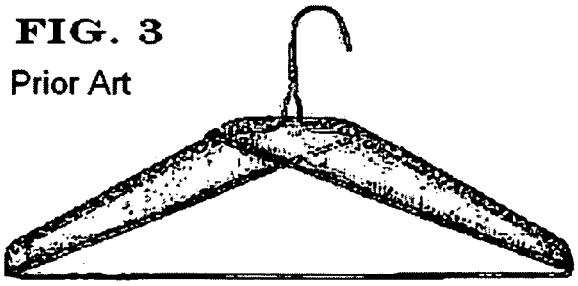
FIG. 3 Prior Art
FIG. 3 Is the prior art of U.S. Pat. No. 3,866,810
Figure 4:
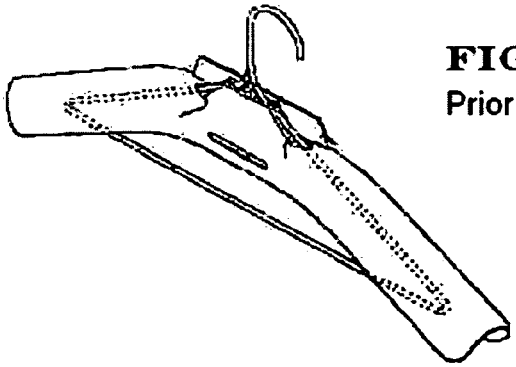
FIG. 4 Prior Art
FIG. 4 Is the prior art of U.S. Pat. No. 6,644,521 B1
Figure 5:
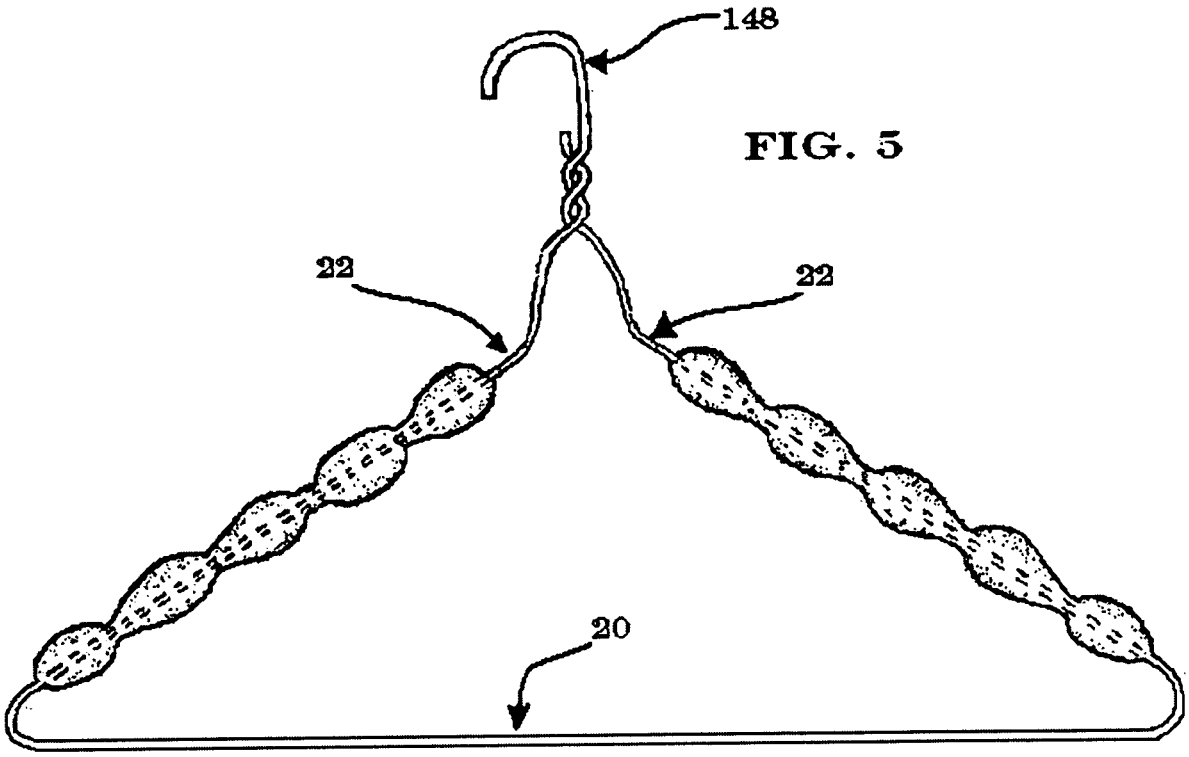
FIG. 5 Is the preferred embodiment of the garment hanger attachment installed on both shoulder supports of a wire hanger.

Referring to FIG. 5, it should be noted that this invention is adapted to the standard commercially available wire hanger that is commonly distributed by dry-cleaning services. The wire hanger having the generally triangular shape comprised of a lower horizontal bar 20, two downwardly sloping bars 22 from a central suspending hook 148 sufficiently large enough to hang from a standard closet rod. The downwardly sloping bars 22, also referred to as shoulder support bars, are typically straight from the central hook 148 to the terminal end of the horizontal bar 24. In some instances, the shoulder support bar 22 may have a secondary shape consistent with a small collared shirt, thus reducing the overall straight length of the shoulder support 22 from the hook 148 to the horizontal bar 20.

Figures 6, 7:
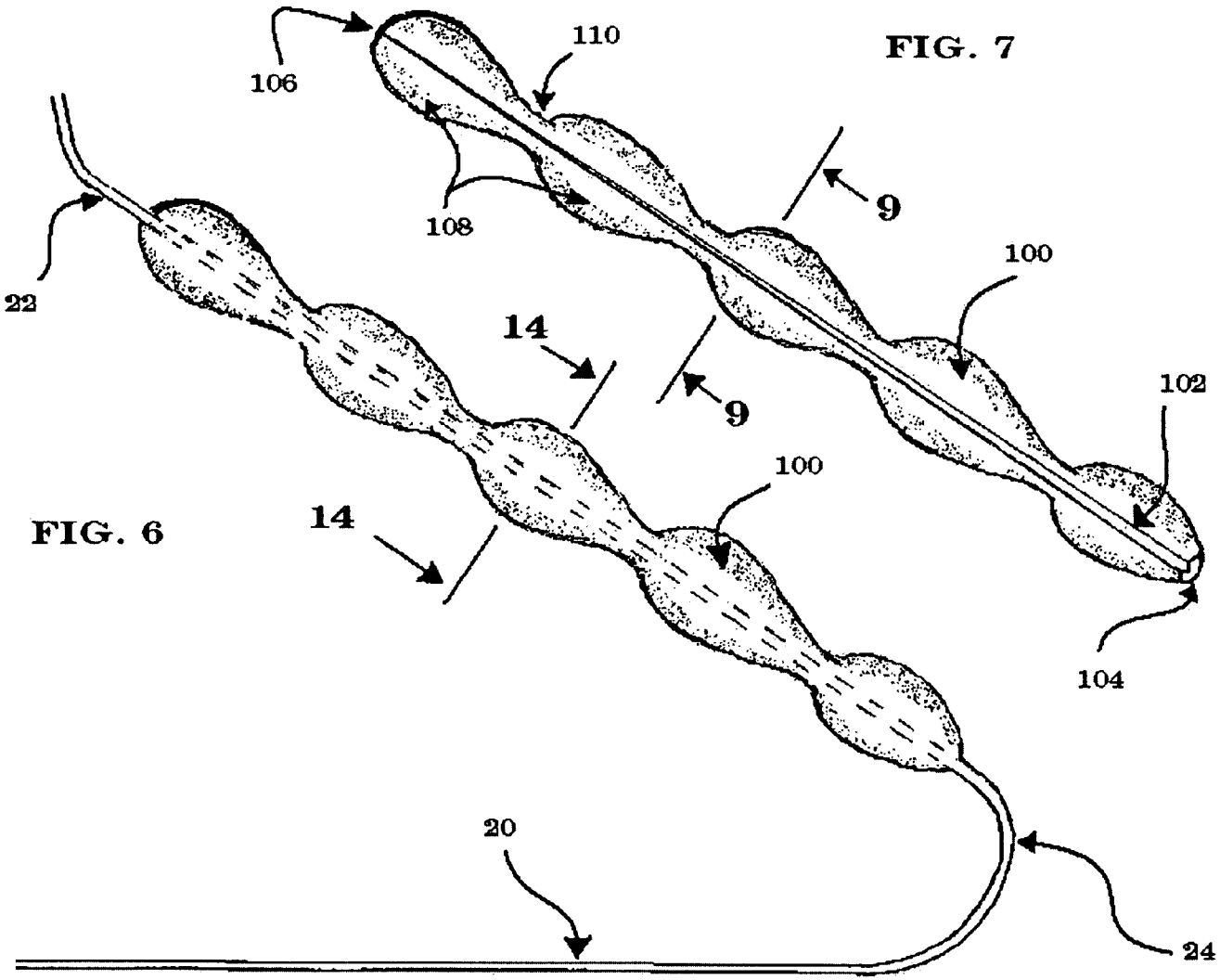
FIG. 6 Is the preferred embodiment of this invention installed on one shoulder support, (enlarged).
FIG. 7 Is the uninstalled hanger attachment illustrating the slit through both ends.

FIG. 7 illustrates a single unit of the hanger attachment 100 of the preferred embodiment of the present invention. The hanger attachment 100 is principally cylindrical with a narrowing/detent 110, and an enlargement 108, along its long axis. The enlargement 108 of the preferred embodiment will be of an ovate shape, this is not to exclude other shapes such as conical enlargements 140 or spherical enlargements 112, unique whimsical enlargements or varied number of enlargements FIGS. 10,11,12,13. Between each spherical enlargement 112 will be a narrowing/detent 110 referred to as "detent," of sufficient length to aid in garment retention. FIG. 6 This narrowing/detent 110 will act as a plateau/index for the garment shoulder straps to be supported and restrained from slipping down the angled shoulder support bars 22. If the garment should shift from one detent, it will not fall, but again come to rest on a subsequent detent. The hanger attachment 100 will be of a symmetrical shape whereas the attachment may be secured either in the upwardly or downwardly sloping attitude and have no effect on functionality. FIG. 12, if a conical shaped enlargement 140 is utilized, the preferred embodiment would be with the cone pointing downward with the large end 142 oriented toward the central hook 148 and the narrower end 144 oriented toward the shoulder support and horizontal support junction, realizing a larger resting surface below each narrowing/detent 110.

Figure 14:
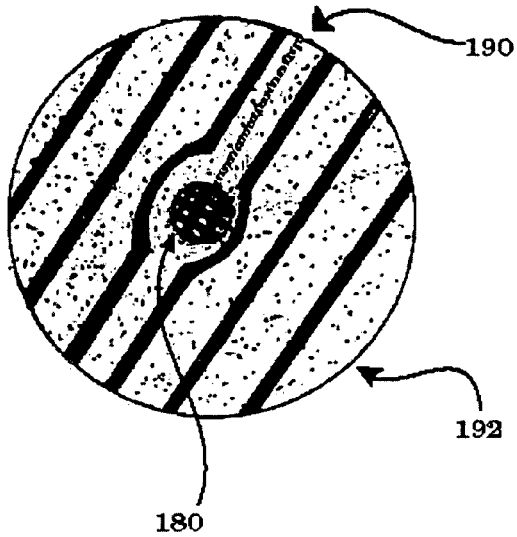
FIG. 14 Is the cross-sectional view illustrating the hanger attachment closed and sealed with adhesive upon a wire hanger shoulder support, with compressive forces on the shoulder support wire depicted by the deviating surface lines.
Figure 9:
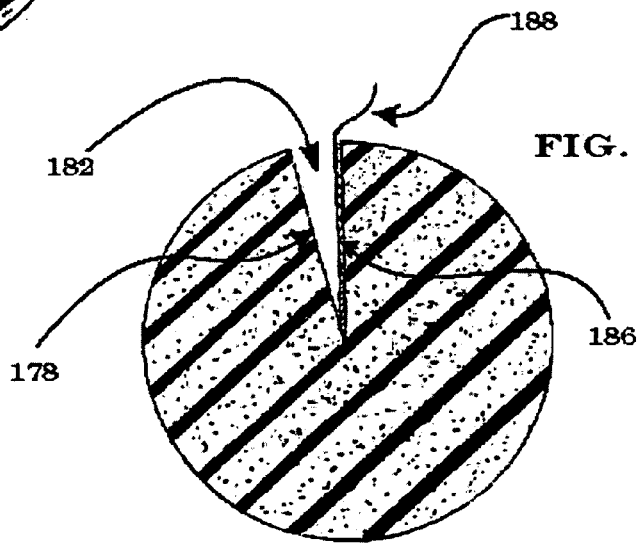
FIG. 9 Is the cross-sectional view illustrating the partial slit with no central hollow core and adhesive with protective paper backing exposed beyond the attachment's outer surface.
Figures 10, 11:
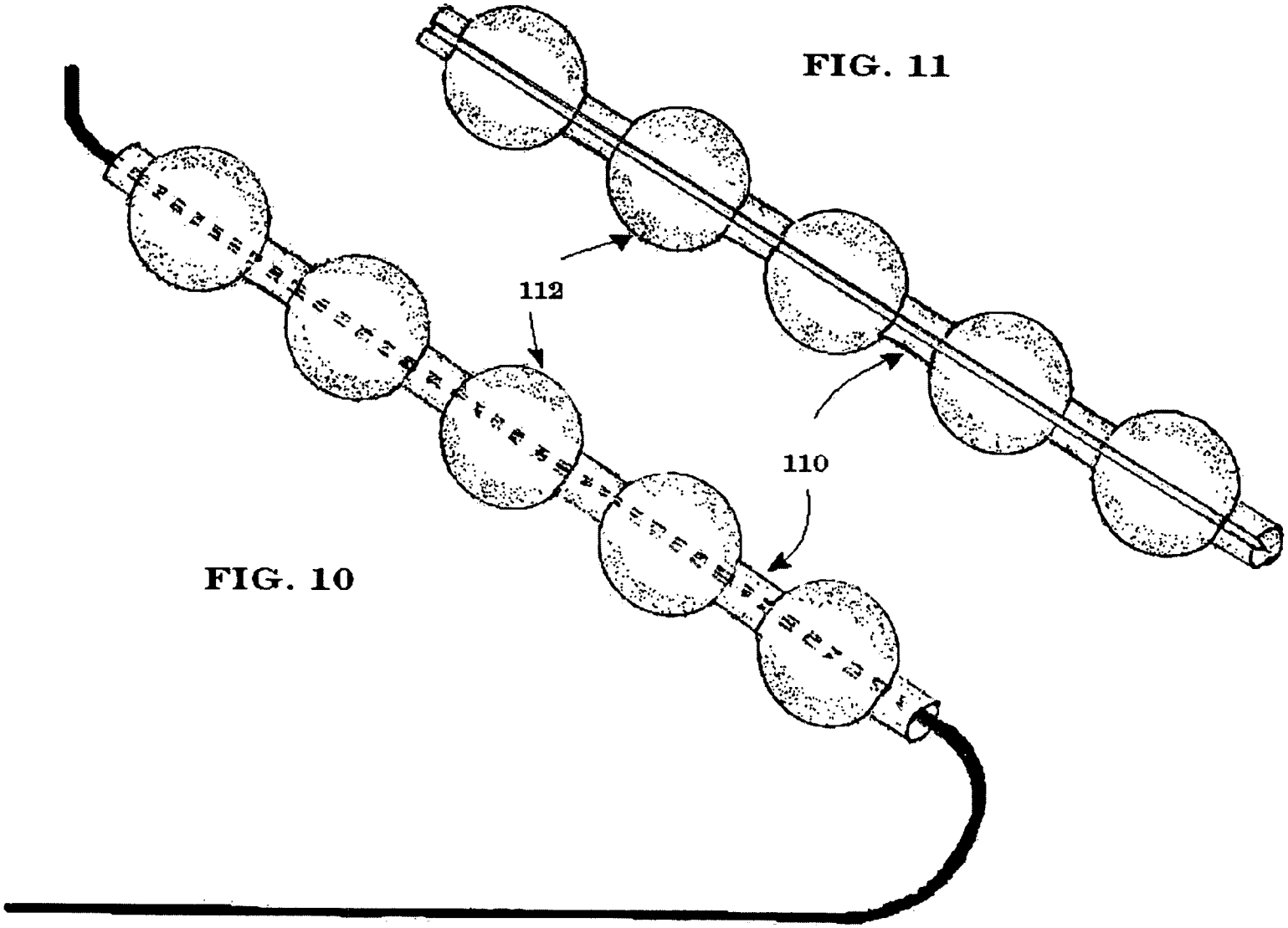
FIG. 10 Is the alternate embodiment of the hanger attachment with spherical enlargements, installed on shoulder support wire hanger.
FIG. 11 Is the alternate embodiment with spherical enlargements illustrating the longitudinal slit extending through both ends.

FIG. 7 Within the hanger attachment 100, will be a longitudinally oriented cut or slit 102 the entire length of the hanger attachment 100 from the end 106 to end 104. FIG. 9 This slit 182, will extend perpendicularly from the outer surface to the central longitudinal axis of the hanger attachment 100. The purpose of this slit 182 is to readily receive and engage the narrow gauge shoulder support bar 180. Within the slit 182 of the hanger attachment 100, on one side of the slit 182, will be placed an adhesive 186 temporarily protected by removable tape 188. The adhesive 186 will be pressed on to the opposite side 178 of the slit 182 once the hanger attachment is properly positioned on the shoulder support bar 180. FIG. 14, Once the hanger attachment 192 is engaged to the shoulder support bar 180, the adhesive 190 will be exposed to the opposing surface of the slit 182 by removing the protective tape backing and pressing together to close and seal the slit as well as prevent the attachment from lateral slippage and axial rotation, essentially constituting a self-supporting device. FIG. 9 The slit 182 should be positioned/oriented downward to allow for gravitationally weighted forces to maintain wire contact with adhesive 186 and prevent separation from the wire hanger by weighted forces on the slit seam line.

FIG. 7 The detents 110 intrinsic to the shape of this invention are placed to accommodate a multitude of garment shoulder straps. For a ladies "spaghetti" strapped blouse, whereas the straps are outwardly placed, the garment straps would be placed most laterally. For a child's item of clothing, the thin garment straps will be positioned more proximal to the inner most detent 110 or even on the wire hanger support above the hanger attachment could be utilized. The detents 110 provide for a level surface or "V" groove for the garment strap to reside and resist the downward forces of gravity and preserve garment strap positioning when the user shifts the wire hanger either in removal from or placement on the closet hanger rod. The natural tendency of the garment is to be pulled by the force of gravity. Because of the angular property of the shoulder support bar and the low coefficient of friction afforded by the painted wire surface, the garments will comply with the gravitational forces and slip laterally until it falls free from the hanger.

With a uniformly shaped hanger attachment, the garment will only resist the gravitational forces until the positional angularity of the wire garment hanger changes sufficiently to overcome the frictional coefficient of the attachment. This invention 100 will greatly enhance the garment retention with greater operational positional angulation of the wire hanger. Furthermore, the forces experienced during the backward and forward shifting of the wire hanger with the garment attached will typically encourage lateral slippage of said garment. This invention resists lateral shift under these circumstances. FIG. 6 Proper placement of this device is to be more laterally-oriented on the shoulder support, proximal to the angle 24, determined by the junction of the horizontal bar 20 and shoulder support bar 22. The foam material of this hanger attachment 100 is of a resilient non-slip nature and should allow for some deformation from compressive forces to encourage positive engagement of the garment shoulder straps with the hanger attachment. The preferred embodiment of the hanger attachment will be of a foam rubber, of a colorfast and non-absorbent nature/material. This does not preclude the use of alternative foam products such as, but not limited to, polyurethane, polystyrene and synthetic foam material. Alternatively a rigid material may also be substituted, such as rigid plastic. Plastic will lend itself to be more applicable, but not limited to, whimsical designs, i.e., animal or floral patterned enlargements.

The use of foam-type material would be either molded to the proper size and thickness or cut and shaped from foam stock. The manufacturing method will be determined by cost/benefit analysis.

Figure 15:
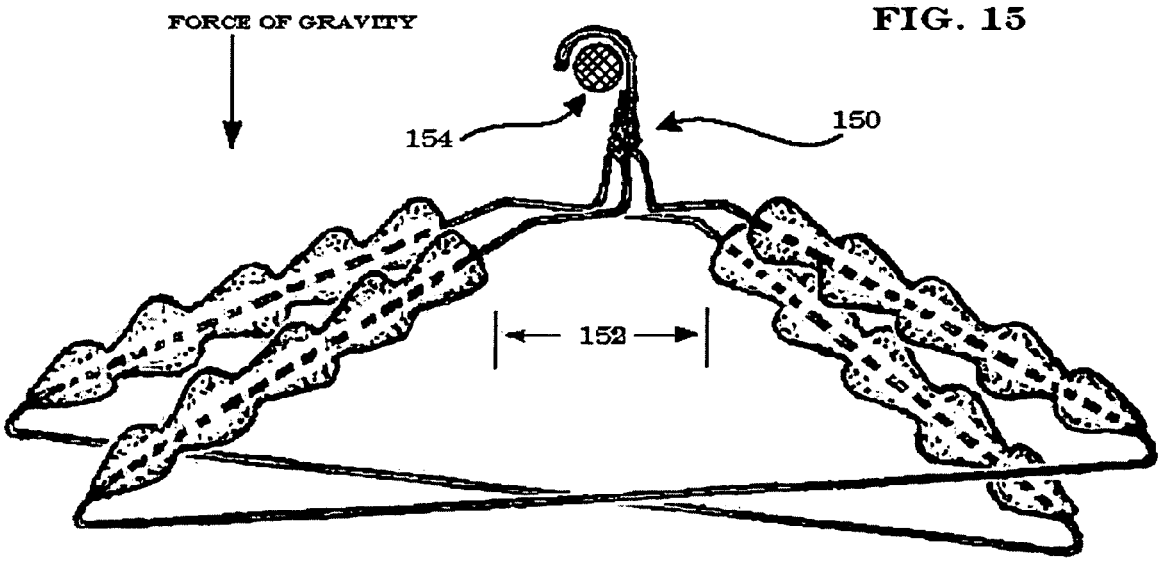
FIG. 15 Is an illustration demonstrating two wire hangers with hanger attachments affixed to the shoulder supports, alternately rotated upon the closet rod.

FIG. 12 The benefit of two hanger attachments disconnected at the central portion of the central hanger hook region 152 is to reduce the space required on the closet rod. With a single unitary attachment extending the entire length across the hanger shoulder support bar and hook, the wire hanger proximity on the closet rod would be limited by twice the radius of the foam attachment for the front and back of the adjacent hangers. FIG. 15 When one garment hanger approximates another, the distance that the hanger attachment extends outward from the hanger support bar will abut the adjacent hanger attachment on the adjacent garment hanger at the location of the central hanger hook region 152. By positioning the foam attachment to the lateral shoulder support bars and refraining from encumbering the central hook area 150 of the wire hanger FIG. 15 the wire hangers can be alternately rotated upon the closet hanger rod 154 and more closely approximate the adjacent hanger by positionally staggering the hanger attachment above or below the adjacent hanger attachment. As the clothing that would typically benefit from this device are of a finer quality meaning of a smaller garment size such as, but not limited to, camisole, halter top, evening gown, tank top or bathing suit, whereby maximizing closet efficiency and garment retention can be affordably achieved.

Figure 8:
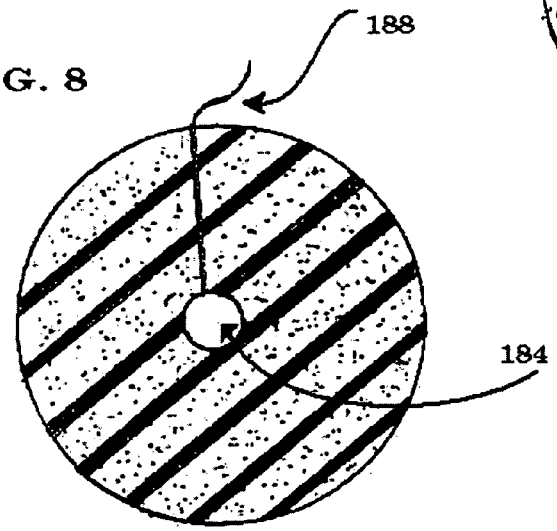
FIG. 8 Is the cross-sectional view of this invention variant with a hollow core, partial slit and adhesive protected by removable paper backing with free end exposed for operator use.

Alternative embodiment; as the principle utility is premised on a wire hanger. FIG. 8 The hanger attachment may be subsequently modified to include the addition of a hollow central axis core 184 approximately equal to the diameter of the plastic hanger shoulder support and subsequent enlargement of the attachment body to accommodate the larger diameter of the non-wire hanger. The procurement and use of the colored plastic garment hangers by consumers would also benefit from this shaped attachment with only slight modification of the previously described embodiment. Similarly, the slit 182 will have an adhesive 186 to mechanically engage the shoulder support bar and disallow slippage, rotation and removal of the hanger attachment.

FIG. 13 Elimination of the centrally located enlargement 164, third in a series of five enlargements as depicted in the illustration, would render a plateau 162 for moderate size shoulder strapped garments.

Figure 16:
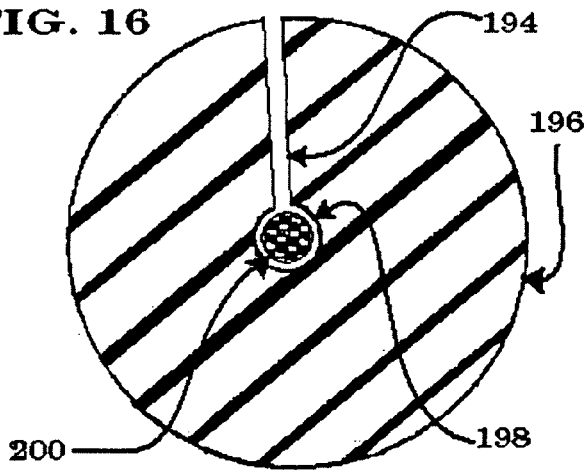
FIG. 16 Is the cross-sectional illustration of a rigid plastic variant of the hanger attachment demonstrating the molded slit and central hollow core with the wire shoulder support bar in situ.

FIG. 16 The adoption of a rigid material for the hanger attachment 196, such as plastic or plasticized foam or similar material, will require minor modification to the overall design for securement of the present invention. A central hollow core 198 at the longitudinal axis will be formed into the hanger attachment 196 during the manufacturing process. This central hollow core 198 will be approximately the same diameter as the wire or plastic hanger shoulder support bar 200 snuggly gripping and cradling the support bar for tight securement. Similarly, the slit 194 will be molded into the hanger attachment 196 during the manufacturing process. The slit 194 will be significantly narrower than the diameter of the wire or plastic shoulder support bar 200 to prevent and resist the inadvertent removal or displacement of the hanger attachment 196 once affixed to the shoulder support bar 200. Due to the tension about the wire shoulder support bar 200 afforded to the hanger attachment 196 by the rigidity of material of choice, no adhesive will be required. Although, no adhesive is required, an adhesive may be utilized at the hollow core 198 to prevent rotation upon the shoulder support bar 200.

What is claimed:

1. A garment hanger attachment adapted to be permanently affixed or removably affixed to the shoulder support portion of the garment hanger comprising:

a. an elongated body manufactured from a rubber or foam material of a resilient consistency, b.

c. a plurality of contoured shapes each separated by adetent and positioned along the longitudinal axis of the external surface of the hanger attachment body to index garment position and prevent lateral slippage of garment, d. a partial slit or cut midway through the body, along the entire length of the body to receive the shoulder support bar, e. an adhesive placed within the slit, f. a unitary body length reasonably the length of one shoulder support of a standard triangular shaped garment hanger.

2. The attachment of claim 1, wherein the length of the attachment body is not to extend beyond the central hook of the garment hanger or beyond the lower angle derived from the junction of the horizontal support bar and downward angled shoulder support bar.

3. The attachment of claim 1, wherein the slit will extend from and perpendicular to the external surface, to the central longitudinal axis.

4. The attachment of claim 3, whereas the slit will be cut into the attachment body after the final molding of a resilient material.

5. The attachment of claim 3, whereas the slit and central hollow core will be molded into the attachment body during the manufacturing process of a rigid material.

6. The attachment of claim 1, wherein the slit will extend through both ends of the attachment.

7. The attachment of claim 1, whereas the plurality of contoured shapes of the surface provides an indexed structure for garment strap placement and retention.

8. The attachment of claim 7, wherein the surface shape can be of multiple ovate, spherical, conical or unique shapes.

9. The attachment of claim 8, whereas the ovate shape will be connected end-to-end in sequence with detents to index the garment shoulder straps.

10. The attachment of claim 8, whereas the spherical shape will be oriented side-by-side and connected to form a running length separated by detents to index the garment shoulder straps.

11. The attachment of claim 8, whereas the conical shape will be oriented with the large end closest to the central hook and small end oriented toward the lateral most aspect of the shoulder support to provide a greater barrier to prevent shifting and slippage of garment.

12. The attachment of claim 11, whereas the orientation of the conical shape, small end to large end, creates a detent to form an index for garment strap position.

13. The attachment of claim 8, whereas the shape, of the attachment can be unique as in the shape of animals and flowers, for aesthetic enhancement.

14. The attachment of claim 1, wherein the adhesive will be sufficiently strong to prevent slippage, rotation, shifting and/or removal either inadvertently or purposefully, and sufficiently bond with the opposing surface within slit.

15. The attachment of claim 14, wherein the attachment has been secured to the shoulder support bar, the hanger attachment will be self-supporting.

16. The attachment of claim 14, whereas the adhesive will bond the hanger attachment securely to the wire and to seal closed the slit, producing a unitary structure with a consistent outer surface.

17. The attachment of claim 1, whereas the attachment will be constructed from polystyrene, sponge rubber, polyurethane, or other resilient material that will reasonably deform under compressive forces and return to it's original shape when the compressive force is removed.

18. The attachment of claim 17, wherein the body is formed by molding or cutting the foam into its final shape.

19. The attachment of claim 17, whereas the attachment will be constructed from a material that is colorfast and non-staining.

20. The attachment of claim 17, whereas the attachment will be constructed from a non-absorbent material.

21. The attachment of claim 17, whereas the foam material will be various colors.

22. The attachment of claim 21, whereas the attachment colors can be both uniform and also non-uniform.

23. The attachment of claim 17, whereas the outer surface of the foam material will be of a non-slip nature.

24. The attachment of claim 1, whereas the attachment will be molded from a rigid plastic or foamed plastic.

25. The attachment of claim 24, whereas the attachment constructed from a rigid plastic or foamed plastic will not require an adhesive.

26. The attachment of claim 24, whereas the spring tension inherent within the rigidity of the plastic material will clip tightly to the hanger support bar.

27. The attachment of claim 1, whereas two units are required for one wire hanger, a left and right shoulder support attachment respectively.

* * * * *

UNITED STATES PATENT AND TRADEMARK OFFICE

CERTIFICATE OF CORRECTION

PATENT NO. : 7,216,786 B2
APPLICATION NO. : 10/998429
DATED : May 15, 2007
INVENTOR(S) : Mikhail et al.

It is certified that error appears in the above-identified patent and that said Letters Patent is hereby corrected as shown below:

Claim 1, line 6: Delete “b”
Claim 1, line 7: Delete “c” and insert --b--
Claim 1, line 8: Delete “adetent” and insert --a detent--
Claim 1, line 12: Delete “d” and insert --c--
Claim 1, line 15: Delete “e” and insert --d--
Claim 1, line 16: Delete “f” and insert --e--

Signed and Sealed this

Fifth Day of February, 2008

JON W. DUDAS
*Director of the United States Patent and Trademark Office*